US011664575B2

(12) United States Patent
Yang et al.

(10) Patent No.: US 11,664,575 B2
(45) Date of Patent: May 30, 2023

(54) SUPPORT PIECE, A RADIATING ELEMENT, AND A BASE STATION ANTENNA

(71) Applicant: CommScope Technologies LLC, Hickory, NC (US)

(72) Inventors: Lei Yang, Suzhou (CN); Fusheng Lv, Suzhou (CN); Bin Ai, Suzhou (CN); Jinchun He, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/569,032

(22) Filed: Jan. 5, 2022

(65) Prior Publication Data

US 2022/0216583 A1 Jul. 7, 2022

(30) Foreign Application Priority Data

Jan. 6, 2021 (CN) ..... 202110011680.7

(51) Int. Cl.
*H01Q 1/12* (2006.01)
*H01Q 5/48* (2015.01)
*H01Q 21/06* (2006.01)

(52) U.S. Cl.
CPC ..... *H01Q 1/12* (2013.01); *H01Q 5/48* (2015.01); *H01Q 21/06* (2013.01); *H01Q 21/062* (2013.01)

(58) Field of Classification Search
CPC ..... H01Q 1/12; H01Q 5/48; H01Q 21/062; H01Q 21/06
USPC ..... 343/792
See application file for complete search history.

(56) References Cited

U.S. PATENT DOCUMENTS 6,067,053 A * 5/2000 Runyon ..... H01Q 21/205 343/820
6,515,633 B2 * 2/2003 Ippolito ..... H01Q 21/26 343/797
7,616,168 B2 * 11/2009 Tillery ..... H01Q 21/26 343/797
9,397,404 B1 * 7/2016 McDevitt ..... H01Q 21/08
10,770,803 B2 9/2020 Varnoosfaderani et al.
2009/0096700 A1 * 4/2009 Chair ..... H01Q 1/246 343/797

(Continued)

FOREIGN PATENT DOCUMENTS

WO 2020060816 A1 3/2020

*Primary Examiner* — Hai V Tran
(74) *Attorney, Agent, or Firm* — Myers Bigel, P. A.

(57) ABSTRACT

A support piece comprises: a first support section configured in the shape of a plate, and a plurality of second support sections; every second support section in the plurality of second support sections is set on the outside of the first support section and is bent relative to the first support section; every second support section comprises at least one support structure. At least a portion of the support structure of the at least one support structure is configured to support a first dipole arm, and at least a portion of the support structure of the at least one support structure is configured to support a second dipole arm; a second arm section on the outside of the first dipole arm is bent relative to the first arm section on the inside toward a first side of the first support section to support the dipole arm; a second arm section on the outside of the second dipole arm is bent relative to the first arm section on the inside toward a second side of the first support section opposite to the first side.

19 Claims, 17 Drawing Sheets

(56) References Cited

U.S. PATENT DOCUMENTS

| | | | | |
|---|---|---|---|---|
| 2012/0133567 | A1* | 5/2012 | Harel | H01Q 5/47 343/798 |
| 2016/0294065 | A1* | 10/2016 | Lindmark | H01Q 21/28 |
| 2018/0198191 | A1* | 7/2018 | So | H01Q 21/0075 |
| 2020/0161748 | A1 | 5/2020 | Isik et al. | |
| 2020/0185838 | A1 | 6/2020 | Li et al. | |

* cited by examiner

SUPPORT PIECE, A RADIATING ELEMENT, AND A BASE STATION ANTENNA

CROSS-REFERENCE TO RELATED APPLICATION

The present application claims priority to Chinese Patent Application No. 202110011680.7, filed Jan. 6, 2021, the entire content of which is incorporated herein by reference as if set forth fully herein.

FIELD

The present disclosure relates to the technical field of wireless communication; specifically, it relates to a support piece, a radiating element, and a base station antenna.

BACKGROUND

As the communication technology develops, more and more radiating elements may be integrated into a base station antenna array. Provided that the overall dimensions of a base station antenna remain unchanged, as the number of radiating elements in an antenna array increases, the distance between adjacent radiating elements usually decreases; as a result, there is increased coupling between them, which degrades the radiating performance of the base station antenna. For example, the upper sidelobe levels and cross polarization ratios deteriorate.

SUMMARY

The purpose of the present disclosure is to provide a support piece, a radiating element, and a base station antenna.

According to a first aspect of the present disclosure, a support piece used for a radiating element is provided; the support piece comprises: A first support section, the first support section being configured in the shape of a plate, and a plurality of second support sections; every second support section in the plurality of second support sections is set on the outside of the first support section and is bent relative to the first support section; every second support section comprises at least one support structure; wherein, at least a portion of the support structure of the at least one support structure is configured to support a first dipole arm, and at least a portion of the support structure of the at least one support structure is configured to support a second dipole arm; a second arm section on the outside of the first dipole arm is bent relative to the first arm section on the inside toward a first side of the first support section to support the dipole arm; a second arm section on the outside of the second dipole arm is bent relative to the first arm section on the inside toward a second side of the first support section opposite to the first side.

According to a second aspect of the present disclosure, a radiating element is provided; the radiating element comprises: A support piece, the support piece comprising a first support section configured in the shape of a plate and a plurality of second support sections, every second support section in the plurality of second support sections being set on the outside of the first support section and being bent relative to the first support section, every second support section comprising at least one support structure, and a plurality of dipole arms; the plurality of dipole arms correspond to the plurality of second support sections one to one; every dipole arm in the plurality of dipole arms comprises a first arm section and a second arm section set on the outside of the first arm section; every second arm section comprises a mounting structure; a dipole arm is the first dipole arm or the second dipole arm; the second arm section of the first dipole arm is bent relative to the first arm section toward a first side of the first support section to support the dipole arm; the second arm section of the second dipole arm is bent relative to the first arm section toward a second side of the first support section opposite to the first side; wherein, at least a portion of the support structure of the at least one support structure is configured to match the mounting structure of the first dipole arm to support the first dipole arm, and at least a portion of the support structure of the at least one support structure is configured to match the mounting structure of the second dipole arm to support the second dipole arm.

According to a third aspect of the present disclosure, a radiating element is provided, the radiating element is configured to be mounted on a reflector, comprising: a first dipole that includes a first dipole arm and a second dipole arm; a second dipole that includes a third dipole arm and a fourth dipole arm, the second dipole extending perpendicularly to the first dipole; wherein each of the first through fourth dipole arms comprises a plurality of widened conductive segments that are connected by a plurality of narrowed conductive segments, and wherein each of the first through fourth dipole arms has a base that is proximate a center of the radiating element and a distal end that is opposite the base, and wherein the distal end of each dipole is bent either rearwardly or forwardly with respect to a plane that is parallel to the reflector.

According to a fourth aspect of the present disclosure, a base station antenna is provided, and the base station antenna comprises the radiating element.

Through the following detailed description of exemplary embodiments of the present disclosure by referencing the attached figures, other features and advantages of the present disclosure will become clearer.

BRIEF DESCRIPTION OF THE DRAWING

The attached figures, which form a part of the specification, describe embodiments of the present disclosure and, together with the specification, are used to explain the principles of the present disclosure.

In the embodiments described below, under some circumstances, the same signs are used among different figures to indicate the same parts or parts with the similar functions, and repeated description is thus omitted. Under some circumstances, similar labels and letters are used to indicate similar items, and thus, once a certain item is defined in one attached figure, it does not need to be further discussed in subsequent attached figures.

For ease of understanding, the positions, dimensions, and ranges of various structures shown in the attached figures and the like may not indicate the actual positions, dimensions, and ranges under some circumstances. Thus, the present disclosure is not limited to the positions, dimensions, and ranges disclosed in the attached figures and the like.

DETAILED DESCRIPTION

Various exemplary embodiments of the present disclosure will be described in detail below by referencing the attached figures. It should be noted: unless otherwise specifically stated, the relative arrangement, numerical expressions and numerical values of components and steps set forth in these embodiments do not limit the scope of the present disclosure.

The following description of at least one exemplary embodiment is actually only illustrative, and in no way serves as a limitation to the present disclosure and its application or use. In other words, the structures and methods discussed in the present disclosure are shown in an exemplary manner to illustrate different embodiments according to the present disclosure. Those of ordinary skill in the art should understand that these examples are merely illustrative, but not in an exhaustive manner, to indicate the embodiments of the present disclosure. In addition, the figures are not necessarily drawn to scale, and some features may be enlarged to show details of some specific components.

The technologies, methods, and equipment known to those of ordinary skill in the art may not be discussed in detail, but when appropriate, the technologies, methods, and equipment should be regarded as a part of the specification.

In all examples shown and discussed herein, any specific value should be construed as merely exemplary, but not limitative. Thus, other examples of the exemplary embodiment may have different values.

Figure 1:
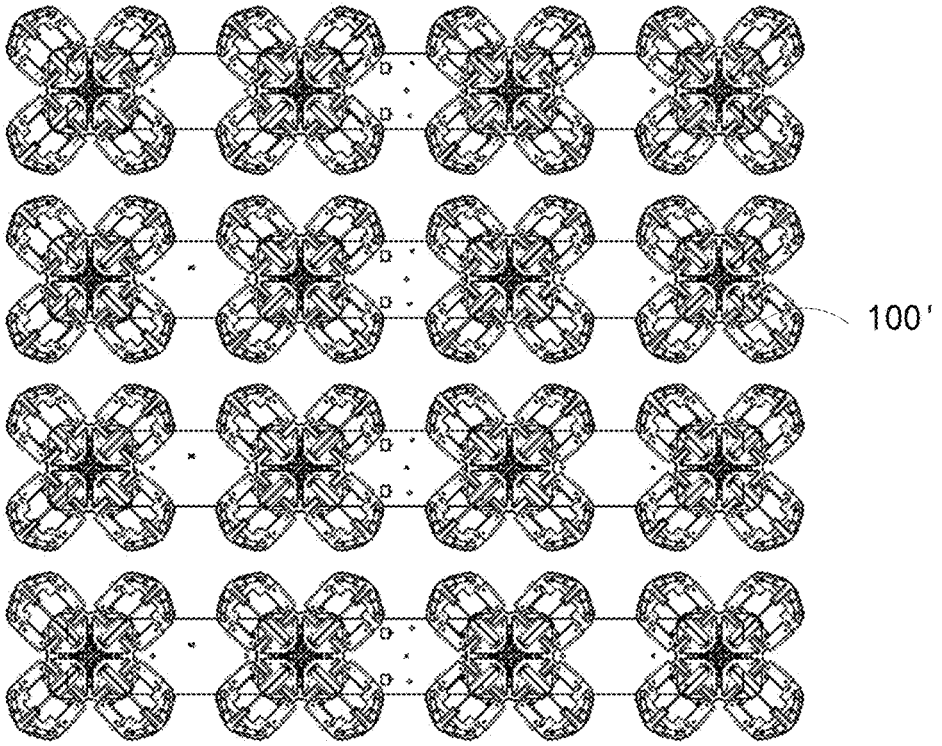
FIG. 1 is a schematic front view of a base station antenna array.
Figure 2:
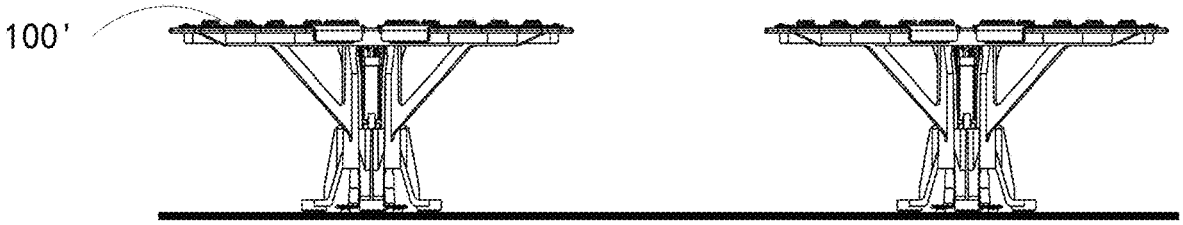
FIG. 2 is a schematic side view of two columns of radiating elements in the antenna array of FIG. 1.

As shown in FIG. 1 and FIG. 2, a base station antenna array includes plurality of radiating elements 100' that are arranged in rows and columns. Each radiating element is mounted to extend forwardly from a reflector of the base station antenna (which is the underlying metal sheet shown in FIG. 2). When the base station antenna is mounted for use, the reflector extends along a generally vertical axis, and the radiating elements 100' extend forwardly from the reflector.

Figure 3:
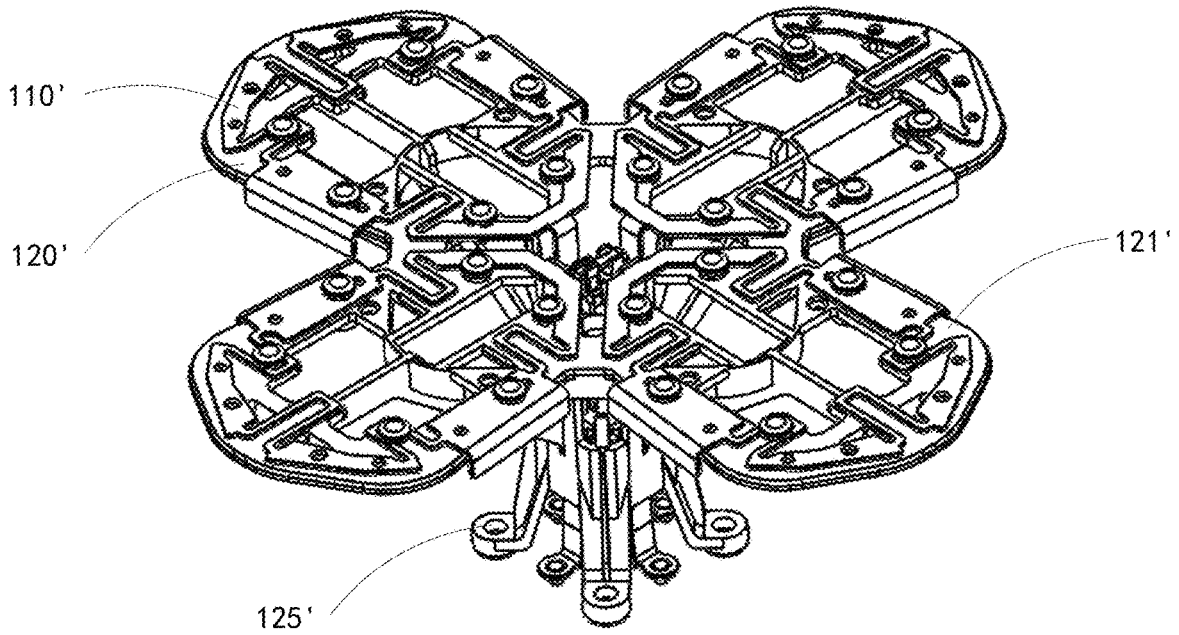
FIG. 3 is a schematic perspective view of one of the radiating elements in the antenna array of FIG. 1.

The structure of radiating element 100' is shown in more detail in FIG. 3. Referring to FIG. 3, the radiating element 100' may comprise dipole arms 110' and support pieces 120' that support the dipole arms 110'. The quantity of dipole arms 110' may be four, and the four dipole arms 110' may be arranged as two dipoles that have polarization directions perpendicular to each other; each dipole comprises two dipole arms 110' extending along opposite directions. The dipole arms 110' may be formed of metal and basically arranged on the same plane. Accordingly, a support piece 120' may comprise a support leg 125' and a support section 121', which is located above the support leg 125' and is configured in the shape of a plate; four dipole arms 110' are directly supported by the support section 121'; the support piece 120' is usually formed of a dielectric material and may comprise a single support piece that supports all four dipole arms 110'.

In the antenna arrays shown in FIG. 1 and FIG. 2, the strength of the coupling of RF signals between adjacent radiating elements 100' is related to the minimum distance between them. As the minimum distance between radiating elements 100' decreases, there is generally increased coupling, which leads to worsened radiating performance for the radiating elements in the array.

Figure 4:
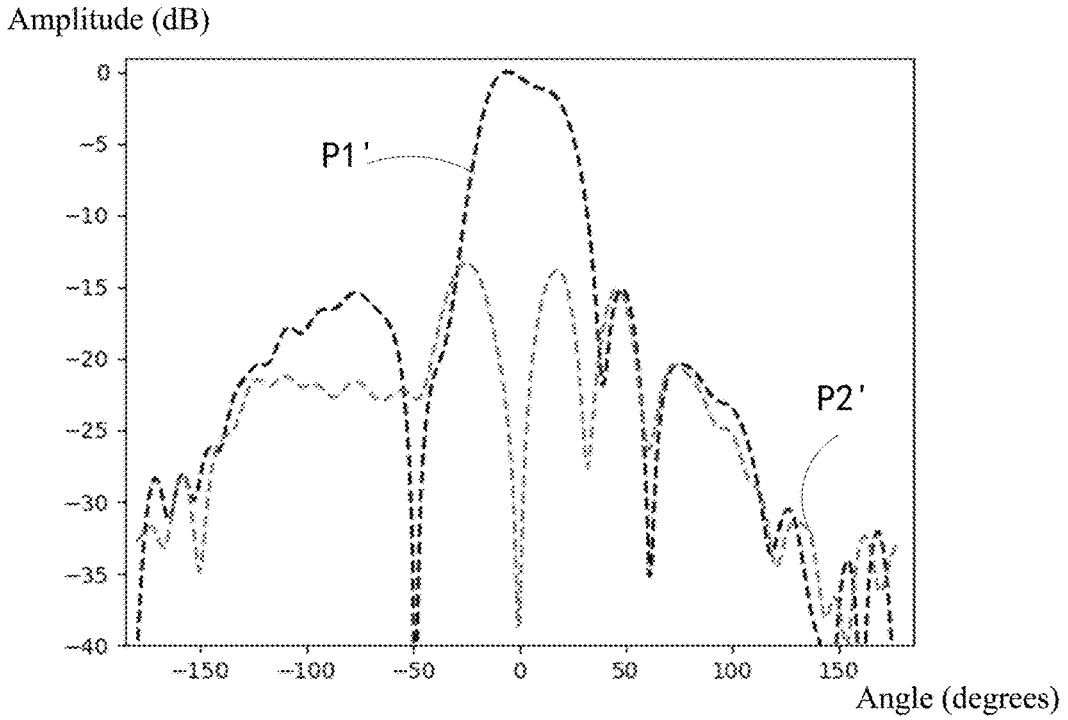
FIG. 4 is an experimentally measured radiation map of the base station antenna of FIG. 1 in the horizontal plane.
Figure 5:
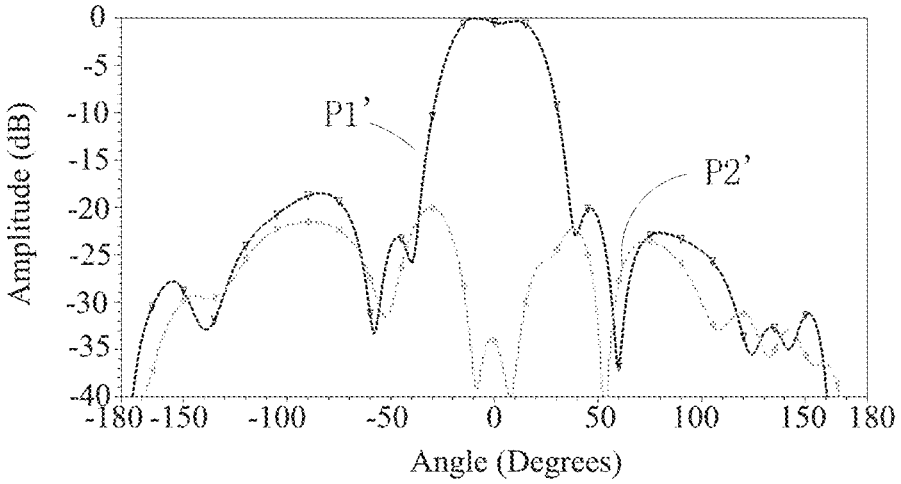
FIG. 5 is a simulated radiation map of the base station antenna of FIG. 1 in the horizontal plane.
Figure 6:
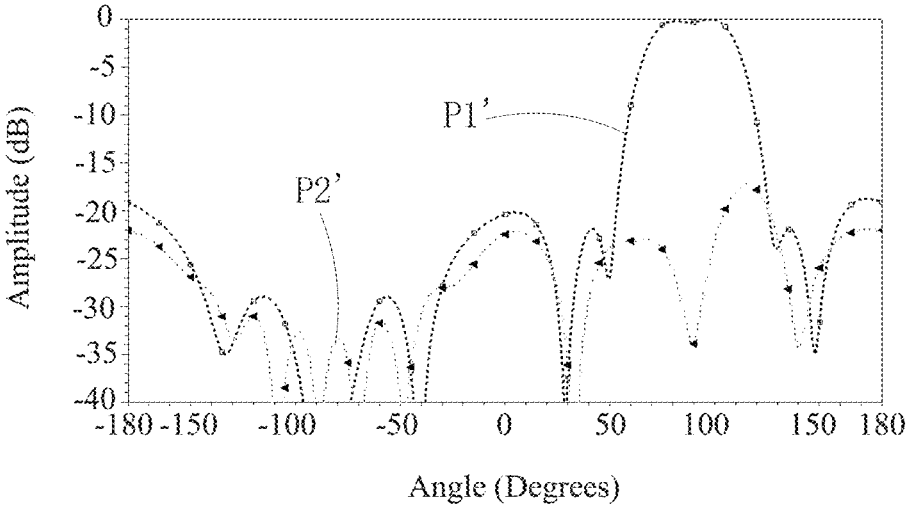
FIG. 6 is a simulated radiation map of the base station antenna of FIG. 1 in the vertical plane.

Specifically, FIG. 4 through FIG. 6 illustrate the experimentally measured and simulated radiation maps of the base station antenna of FIG. 1. In FIGS. 4-6, P1' indicates the primary polarization component and P2' indicates the cross polarization component. As can be seen in FIG. 4 through FIG. 6, the upper sidelobe level of the primary polarization is very high and may even exceed −15 dB, and the cross polarization ratio of the primary polarization component and cross polarization component is also very low.

Figure 7:
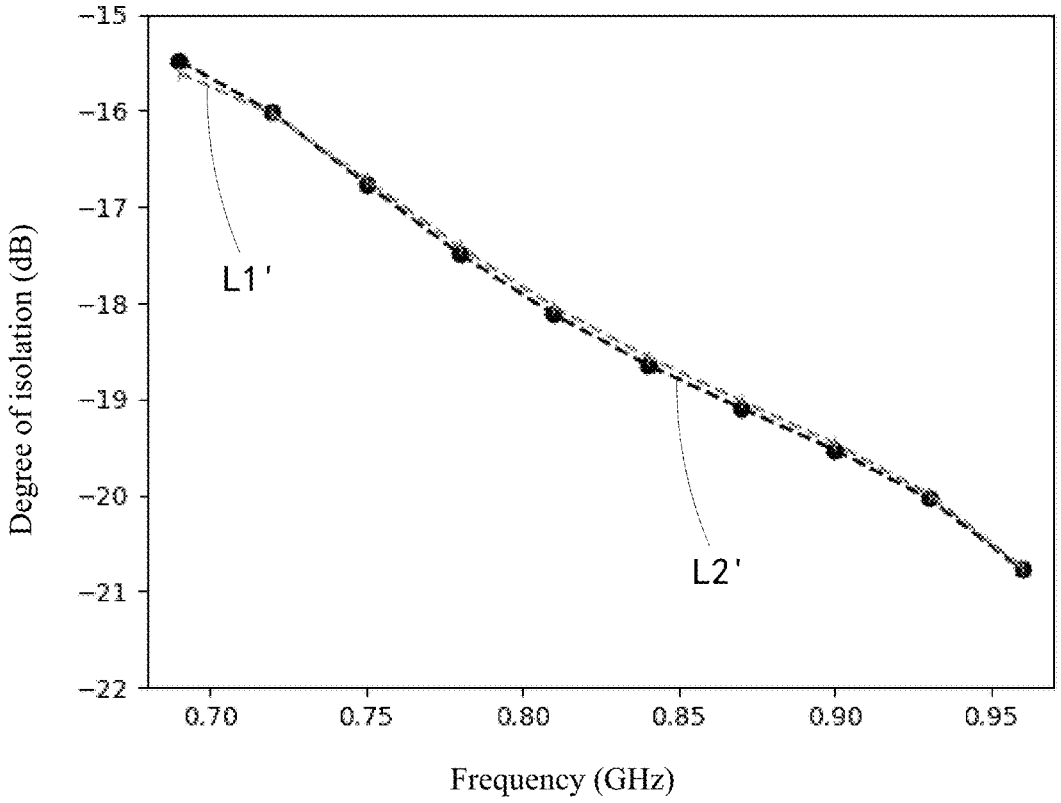
FIG. 7 is a graph of the simulated interband isolation of the two columns of radiating elements illustrated in FIG. 2.

FIG. 7 is a graph of the simulated interband isolation of the two columns of radiating elements shown in FIG. 2. In FIG. 7, L1' indicates the degree of isolation between the input ports of the two columns of radiating elements having the first polarization, and L2' indicates the degree of isolation between the input ports of the two columns of radiating elements having the second polarization. As can be seen in FIG. 7, the interband isolation between the two columns of radiating elements is not ideal either.

To improve performance, the present disclosure proposes using a new support piece for a radiating element and a corresponding radiating element. In the radiating element of the present disclosure, a dipole arm may comprise a first arm section and a second arm section that is bent relative to the first arm section, i.e., the dipole arm is no longer limited to being placed on the same plane. The bent second arm section is beneficial for reducing the minimum distance between dipole arms of adjacent radiating elements in the antenna array, which thus reduces the coupling between radiating elements and improves the radiation performance.

As shown in FIG. 8 through FIG. 16, the radiating element 100 may comprise a plurality of dipole arms 110 and a support piece 120 (which may be implemented as a monolithic structure, as shown, or as multiple individual pieces).

Figure 16:
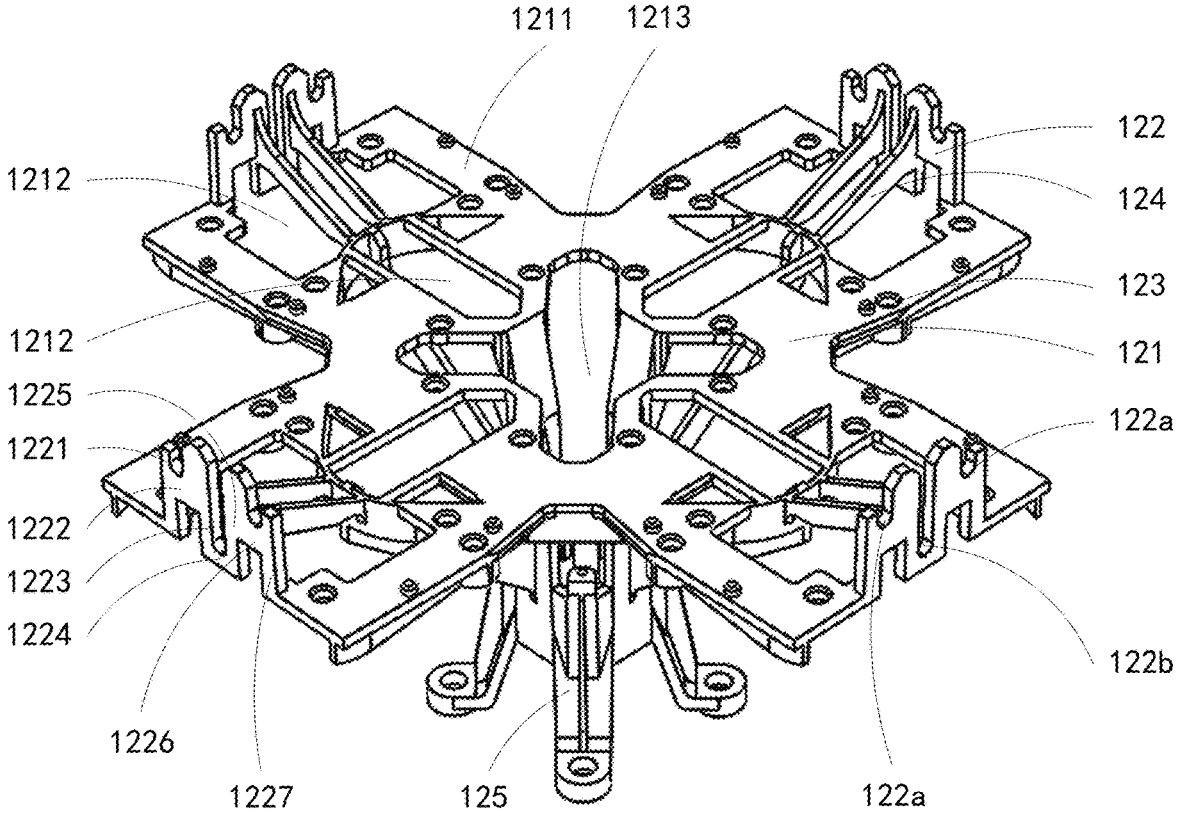
FIG. 16 is a schematic perspective view of a support piece of the radiating elements of FIGS. 8 and 12.

Specifically, as shown in FIG. 16, the support piece 120 may comprise a first support section 121 set in the shape of a plate and a plurality of second support sections 122. Each second support section 122 extends from a respective outer edge of the first support section 121 and is bent relative to the first support section 121.

Figure 11:
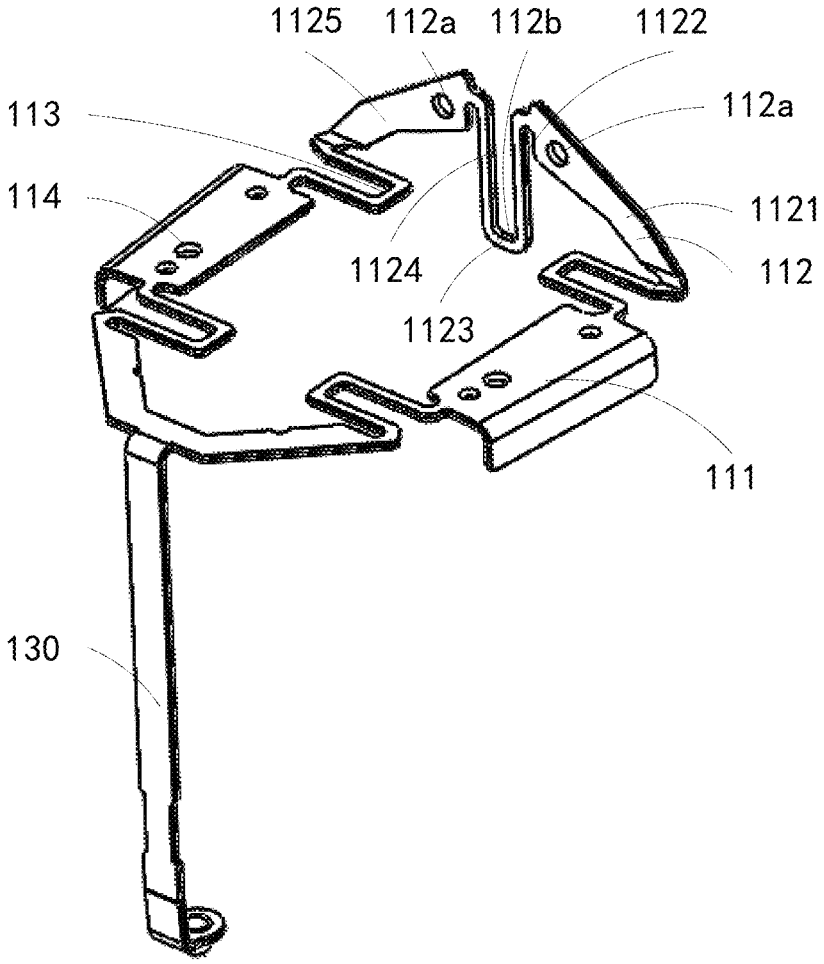
FIG. 11 is a schematic perspective view of a first dipole arm and a feeding section of the radiating element of FIG. 8.
Figure 15:
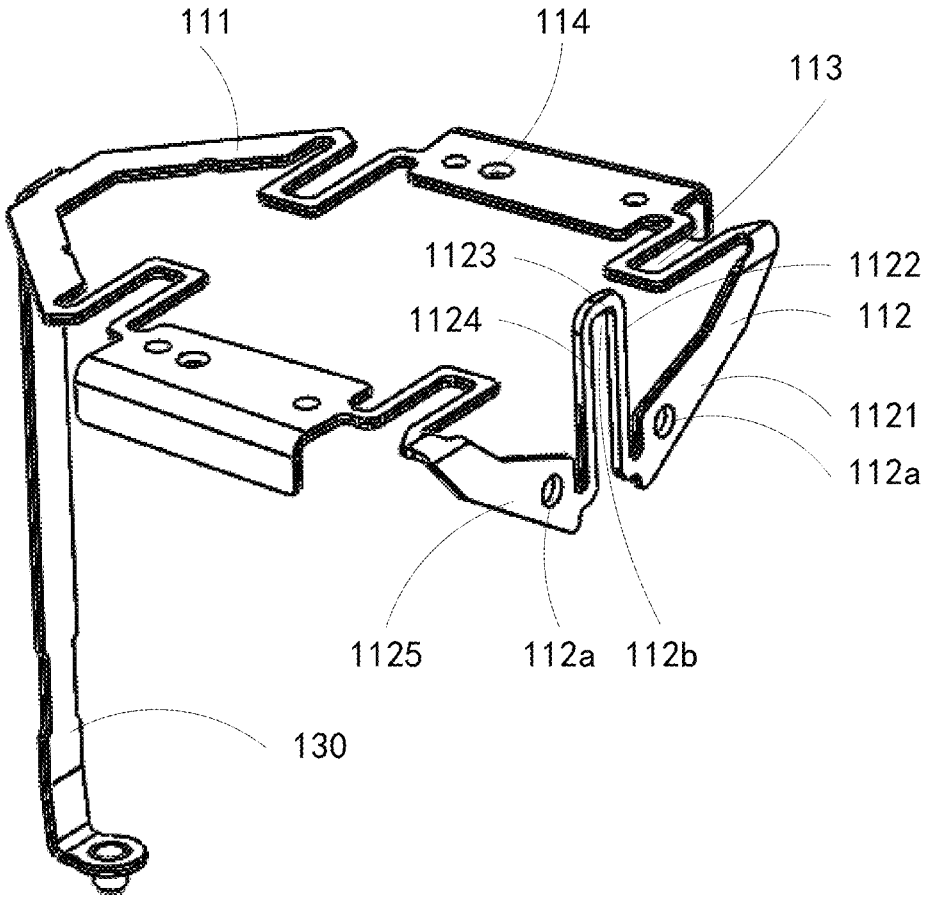
FIG. 15 is a schematic perspective view of a second dipole arm and a feeding section of the radiating element of FIG. 12.

As shown in FIG. 11 and FIG. 15, each dipole arm 110 may comprise a first arm section 111 and a second arm section 112 set on the outside of the first arm section 111. In the first dipole arm shown in FIG. 11, the second arm section 112 is bent relative to the first arm section 111 toward a first side of the first support section 121 to support the dipole arm, i.e., it is bent forwardly as shown in the FIG. 11; bending second arm section 112 forwardly may reduce interference between dipole arm 110 and other components of the base station antenna that may be mounted behind dipole arm 110. In the second dipole arm shown in FIG. 15, the second arm section 112 is bent relative to the first arm section 111 toward a second side of the first support section opposite to the first side, i.e., it is bent rearwardly as shown in the FIG. 15; bending the section arm section 112 of dipole arm 110 rearwardly may avoid the increase in the extent to which the radiating element 100 extends forwardly from a reflector of the base station antenna that occurs with the dipole arm shown in the FIG. 11. In one exemplary embodiment shown in FIG. 8, all dipole arms 110 are the first dipole arms that have a second section that is bent forwardly; in another exemplary embodiment shown in FIG. 12, all dipole arms 110 are the second dipole arms bent rearwardly. It can be understood that in some other embodiments, in the same radiating element, some dipole arms may be the first dipole arms bent forwardly and other dipole arms may be the second dipole arms bent rearwardly to meet various requirements.

As shown in FIG. 8 through FIG. 10 and FIG. 12 through FIG. 14, the first arm section 111 of each dipole arm 110 may be supported by a first support section 121 of the support piece 120 and each second arm section 112 of the dipole arm 110 may be supported by a corresponding second support section 122 of the support piece 120 respectively.

The degree of the bend of the second support section 122 in the support piece 120 relative to the first support section 121 may be determined according to the degree of the bend of the second arm section 112 in the dipole arm 110 relative to the first arm section 111. To utilize space as much as possible and avoid the interference among different components at the same time, the second arm section 112 may be bent to be perpendicular (or basically perpendicular) to the first arm section 111, i.e., the plane of the second arm section 112 and the plane of the first arm section 111 may be perpendicular or basically perpendicular to each other. Accordingly, the second support section 122 may be perpendicular (or basically perpendicular) to the first support section 121.

Figure 8:
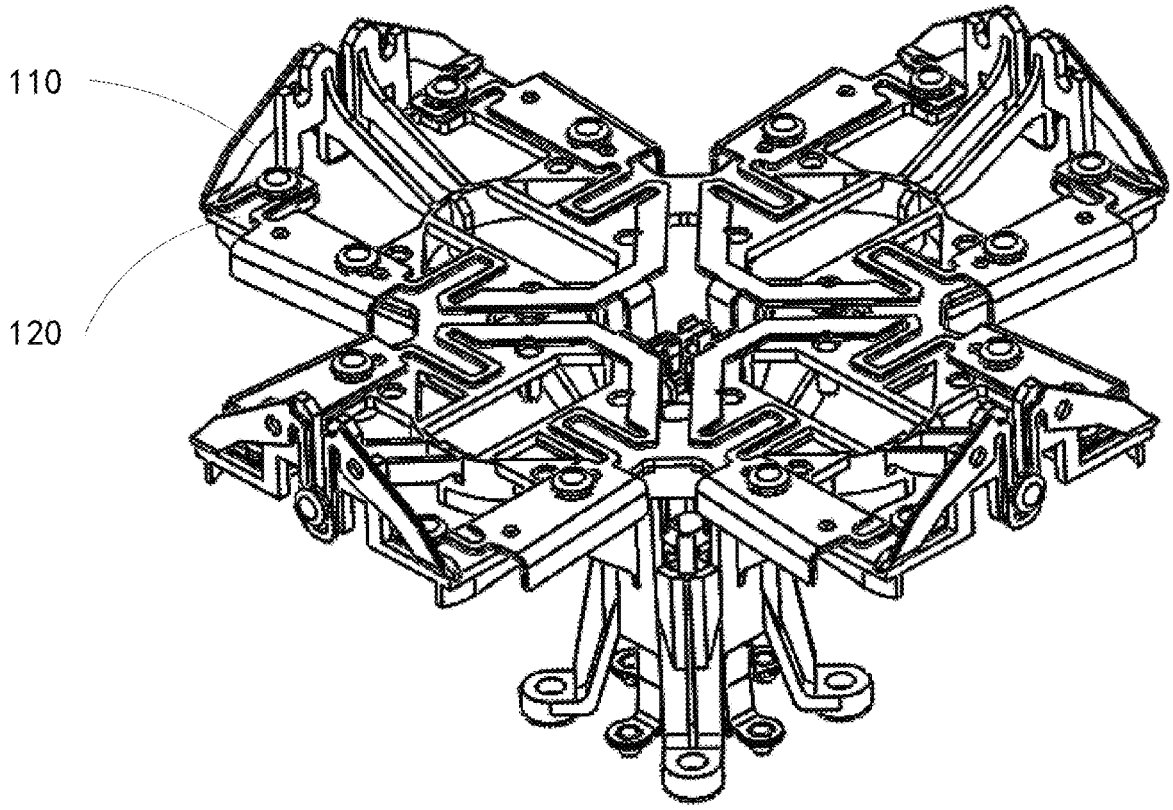
FIG. 8 is a schematic perspective view of a radiating element according to an exemplary embodiment of the present disclosure.
Figure 9:
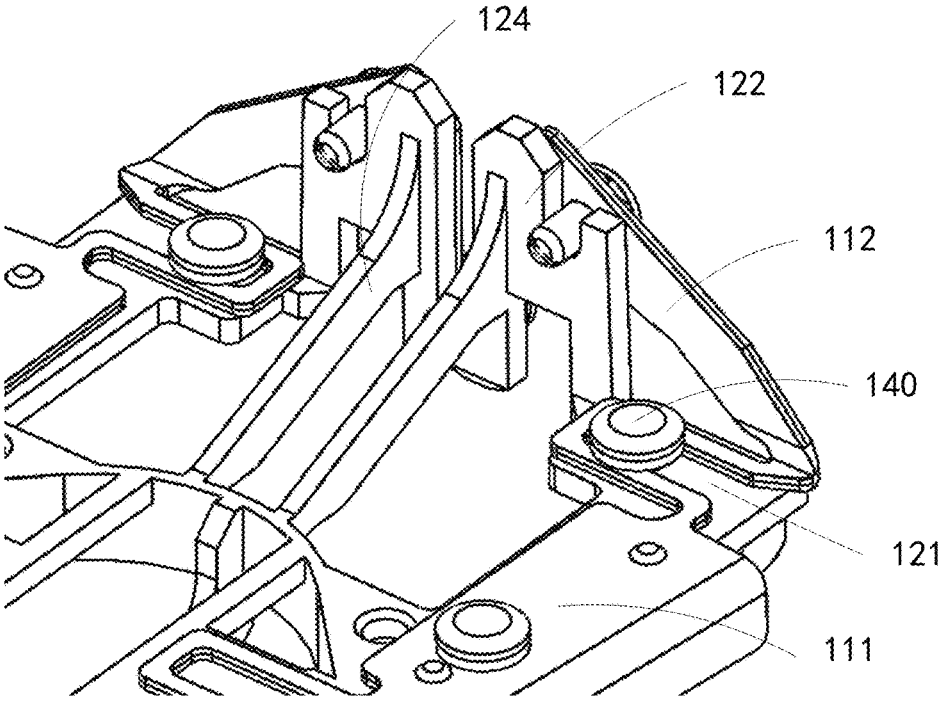
FIG. 9 is an enlarged view of a portion of the radiating element of FIG. 8.
Figure 10:
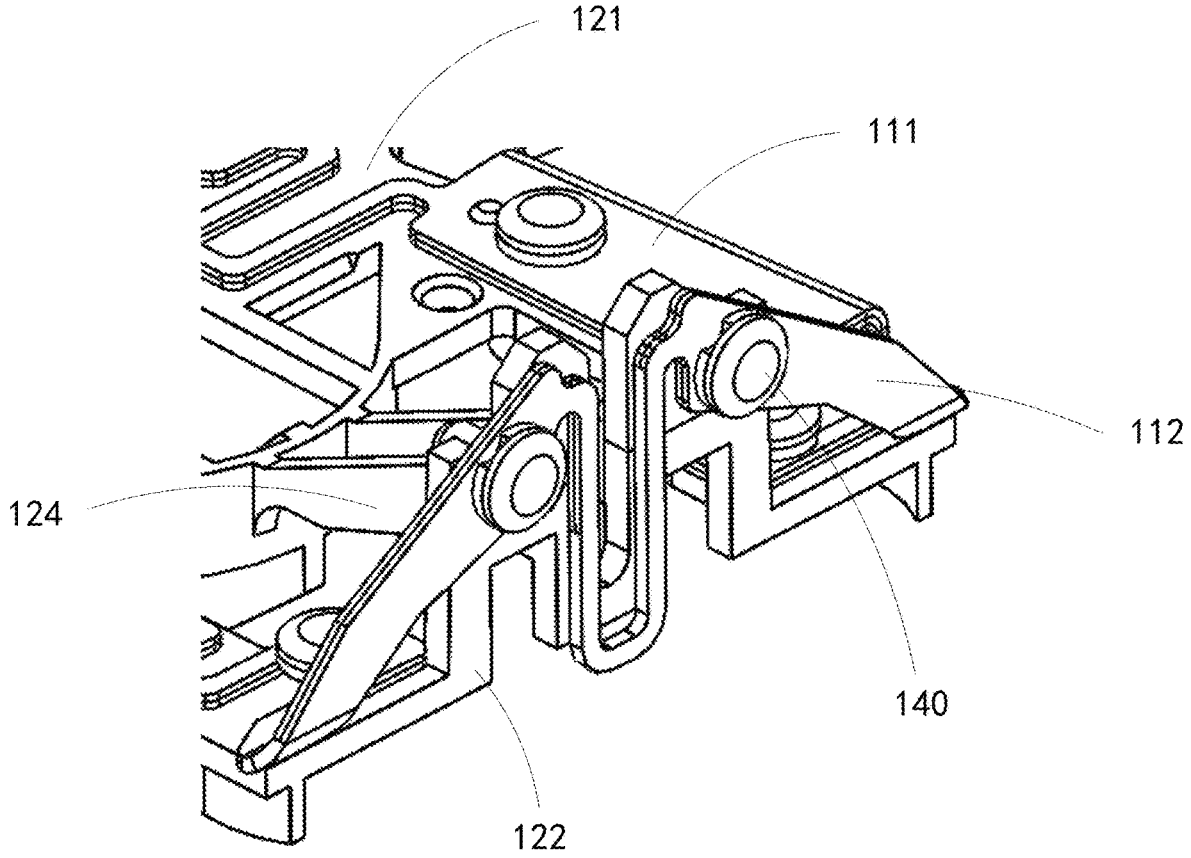
FIG. 10 is an enlarged view of another portion of the radiating element of FIG. 8.
Figure 12:
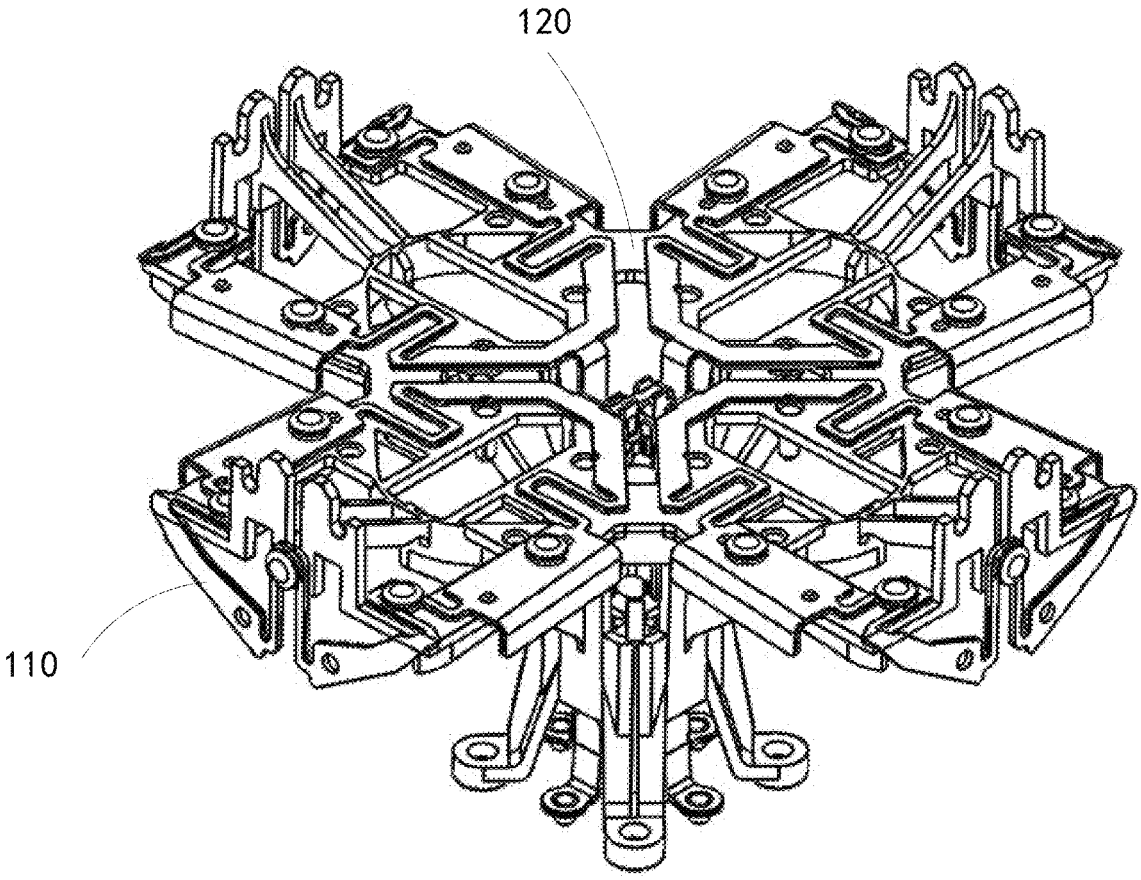
FIG. 12 is a schematic perspective view of a radiating element according to another exemplary embodiment of the present disclosure.
Figure 13:
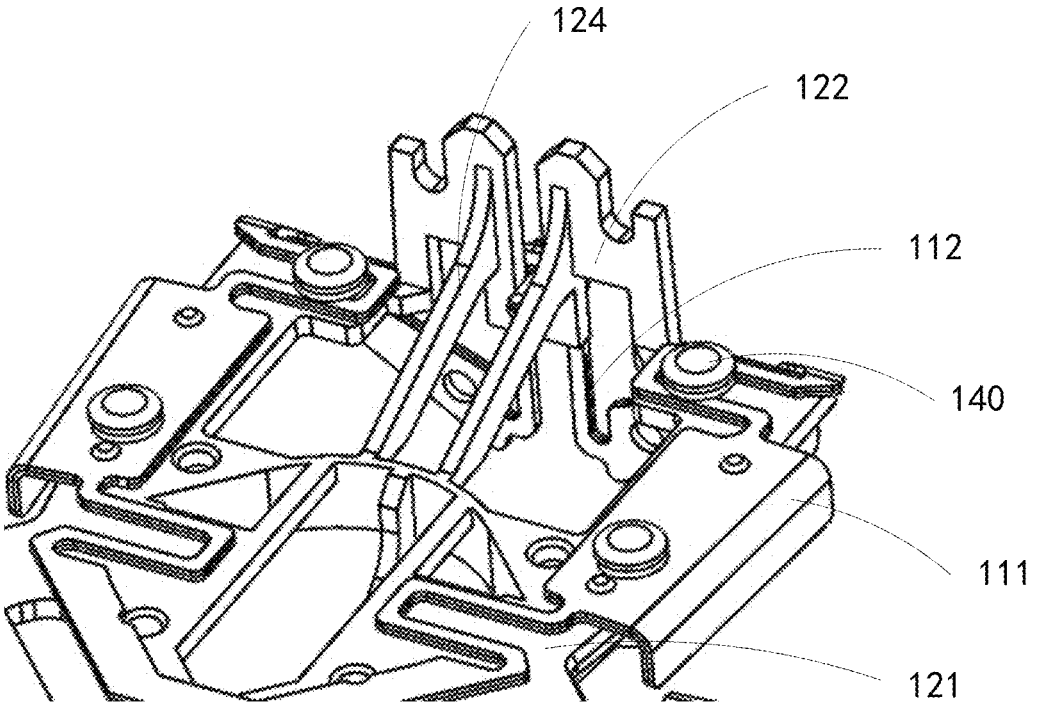
FIG. 13 is an enlarged view of a portion of the radiating element of FIG. 12.
Figure 14:
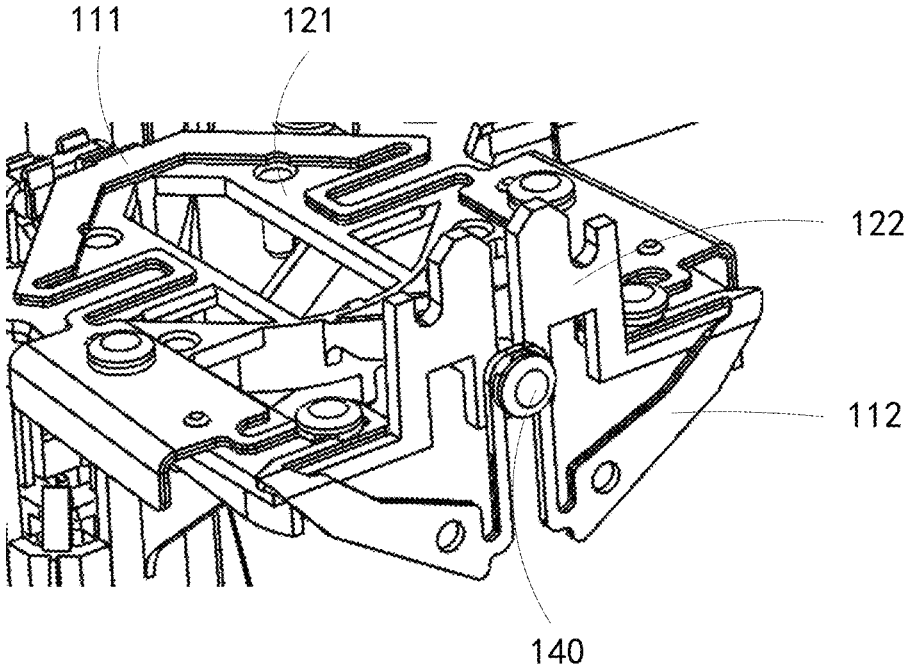
FIG. 14 is an enlarged view of another portion of the radiating element of FIG. 12.

In the exemplary embodiments shown in FIG. 8 and FIG. 12, by bending the second arm section 112 of the dipole arm 110, the the footprint of the radiating element 100 (i.e., the area of the radiating element when viewed from the front) may be decreased, which thus increases the minimum distance between adjacent radiating elements 100 in the antenna array to improve the radiation performance of the base station antenna.

Figure 17:
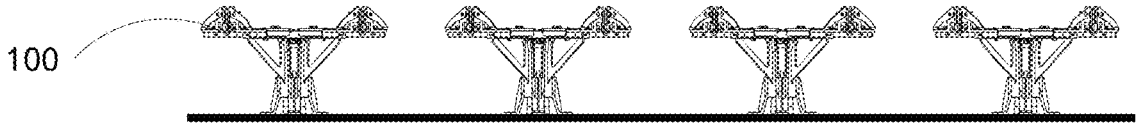
FIG. 17 is a schematic side view of a base station antenna comprising a plurality of the radiating elements of FIG. 8 according to an exemplary embodiment of the present disclosure.
Figure 18:
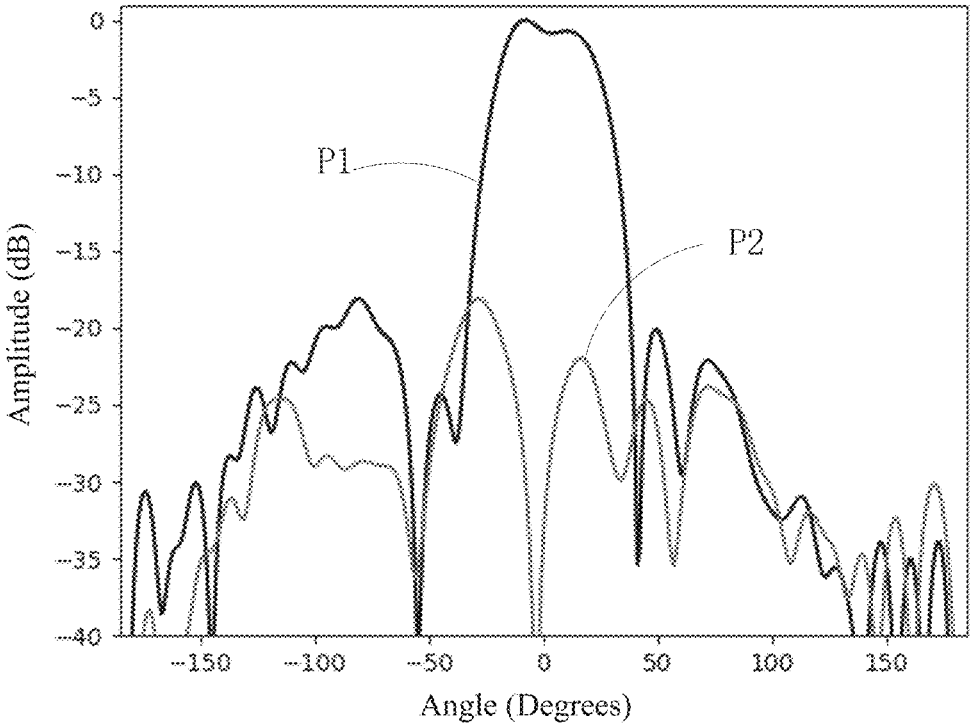
FIG. 18 is an experimentally measured radiation map of the base station antenna of FIG. 17 in the horizontal plane.
Figure 19:
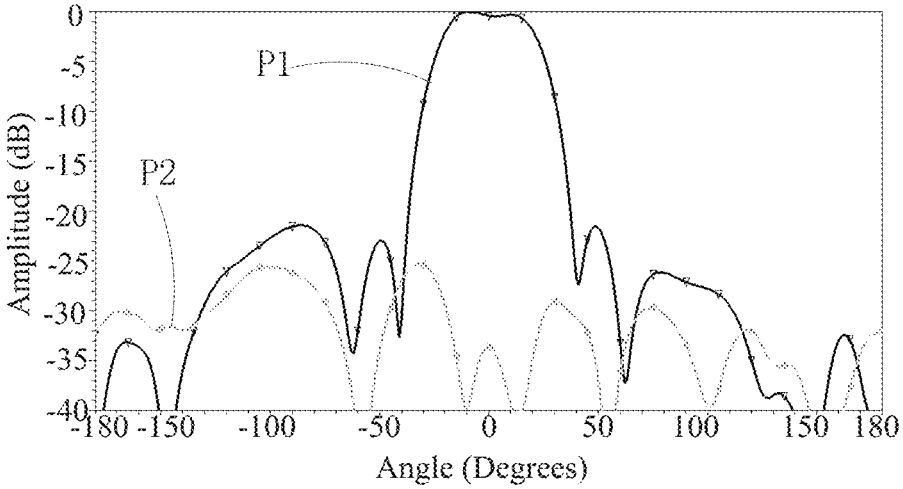
FIG. 19 is a simulated radiation map of the base station antenna of FIG. 17 in the horizontal plane.
Figure 20:
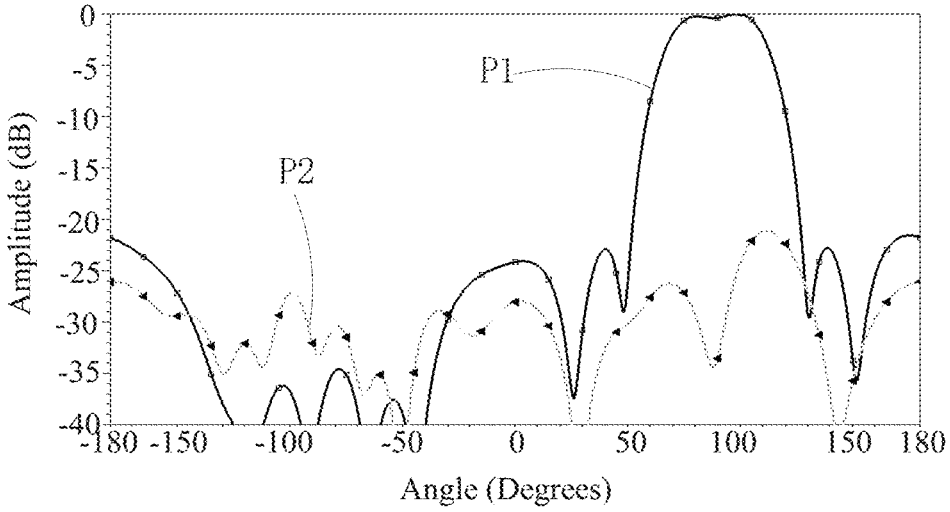
FIG. 20 is a simulated radiation map of the base station antenna of FIG. 17 in the vertical plane.

FIG. 17 is a schematic of the base station antenna comprising the radiating element in FIG. 8 according to an exemplary embodiment of the present disclosure; the base station comprises a 4×4 antenna array (i.e., a total of sixteen radiating elements 100 that are arranged in four rows and four columns when the base station antenna is viewed from the front). FIG. 18 is an experimentally measured radiation map of the base station antenna of FIG. 17. FIG. 19 is a simulated radiation map of the base station antenna of FIG. 17 in the horizontal plane. FIG. 20 is a simulated radiation map of the base station antenna of FIG. 17 in the vertical plane. In FIGS. 18-20, P1 indicates the primary polarization component, and P2 indicates the cross polarization component. Compared with the radiation maps shown in FIG. 4 through FIG. 6, it can be seen that by configuring radiating elements with dipole arms having outer sections that are bent forwardly or rearwardly, the upper sidelobe level of the primary polarization is decreased in the radiation maps, and the cross polarization ratio is improved.

Figure 21:
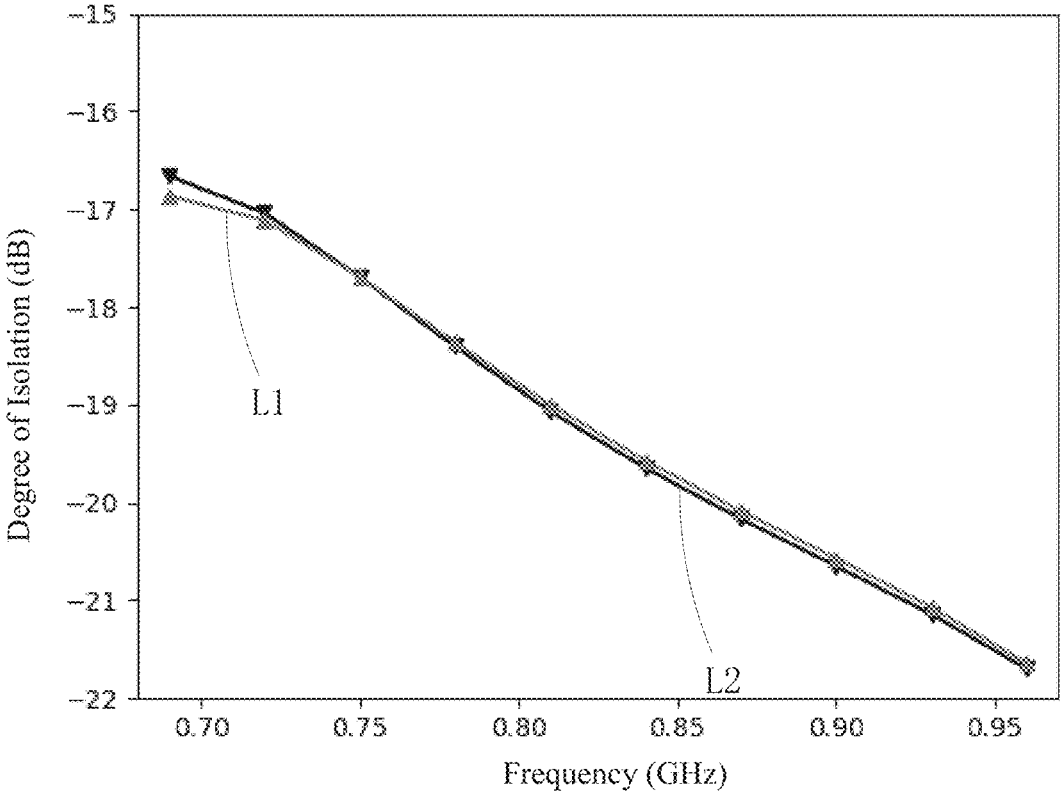
FIG. 21 is a graph of the simulated interband isolation of the base station antenna of FIG. 17.

FIG. 21 is a graph of the simulated interband isolation of the base station antenna in FIG. 17, where L1 indicates the degree of isolation between the input ports of two columns of radiating elements on the first polarization, and L2 indicates the degree of isolation between the input ports of two columns of radiating elements on the second polarization. By comparing FIG. 7 and FIG. 21 it can be seen that by using radiating elements with dipole arms that are bent forwardly or rearwardly the interband isolation between two columns of radiating elements may be improved.

Figure 22:
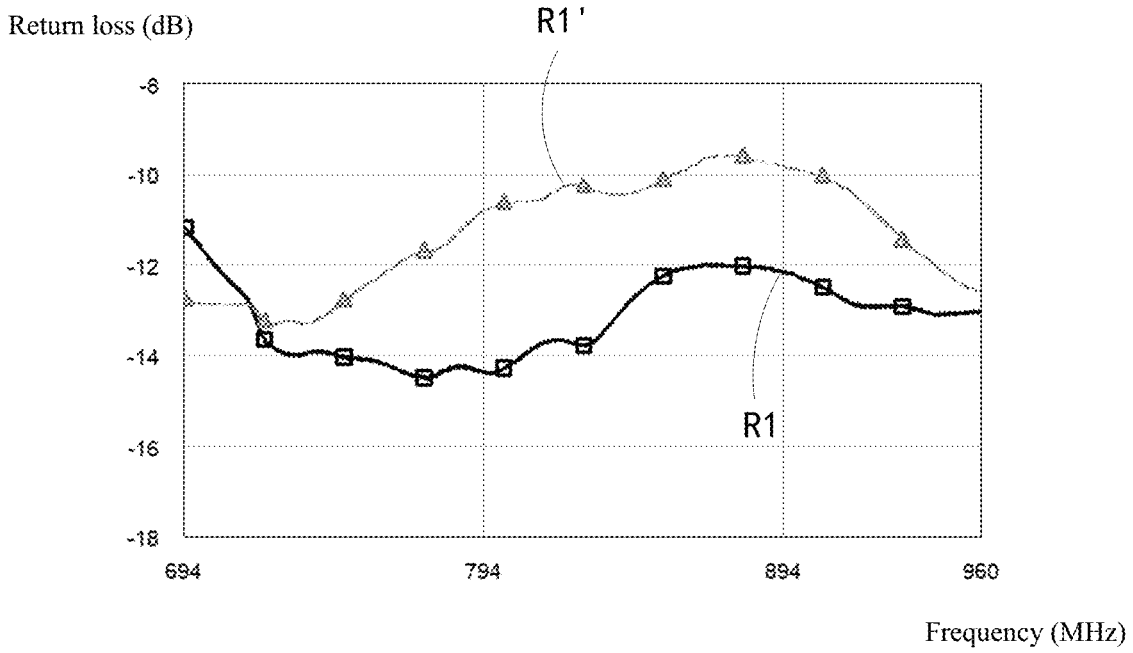
FIG. 22 is a return loss diagram of a first input port of a radiating element array of the base station antenna arrays of FIGS. 2 and 17.
Figure 23:
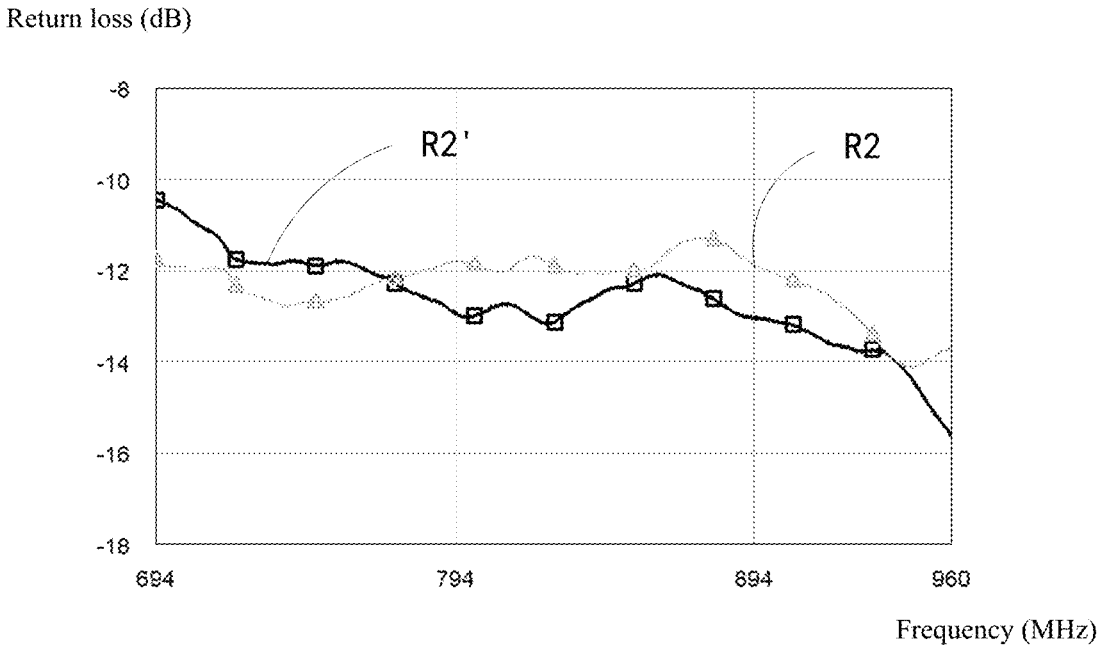
FIG. 23 is a return loss diagram of a second input port of a radiating element array of the base station antenna arrays of FIGS. 2 and 17.

FIG. 22 is a return loss diagram of a first input port of the base station antenna in FIG. 2 and FIG. 17. In FIG. 22R1' indicates the return loss of the first input port of the base station antenna in FIG. 2, and R1 indicates the return loss of the first input port of the base station antenna in FIG. 17. FIG. 23 is a return loss diagram of a second input port of the base station antenna in FIG. 2 and FIG. 17. In FIG. 23 R2' indicates the return loss of the second input port of the base station antenna in FIG. 2, and R2 indicates the return loss of the second input port of the base station antenna in FIG. 17. In these figures, the first input port and the second input port are input ports for the same column of radiating elements and correspond to two polarization directions perpendicular to each other. As seen in FIG. 22 and FIG. 23, at most frequency points, by using radiating elements with dipole arms bent forwardly or rearwardly, the return loss may be reduced.

Figure 24:
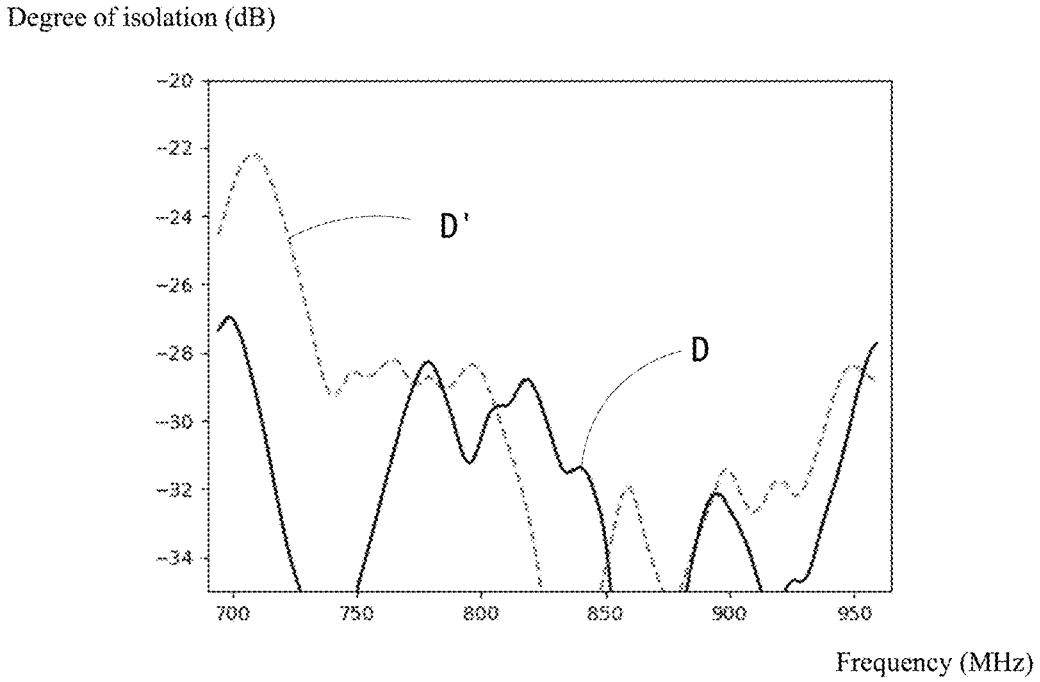
FIG. 24 is a graph of the simulated intraband isolation of a radiating element array of the base station antenna array in FIG. 2 and FIG. 17.

FIG. 24 is a graph of the simulated intraband isolation of the antenna arrays of FIG. 2 and FIG. 17, i.e., the degree of isolation between the first input port and the second input port of the same column of radiating elements corresponding to two polarization directions perpendicular to each other. In FIG. 24, D' indicates the degree of intraband isolation of the antenna array in FIG. 2, and D indicates the degree of intraband isolation of the antenna array in FIG. 17. As seen in FIG. 24, at most frequency points, by using radiating elements with dipole arms bent forwardly or rearwardly, the degree of intraband isolation is improved.

Figure 25:
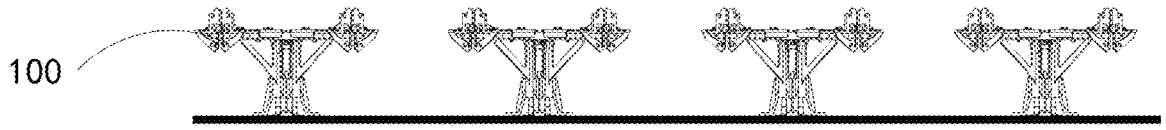
FIG. 25 is a schematic side view of a base station antenna comprising the radiating element in FIG. 12 according to another exemplary embodiment of the present disclosure.

It can be understood that a base station antenna of another exemplary embodiment, as shown in FIG. 25, may be formed using the radiating element shown in FIG. 12. In such a base station antenna, the radiation performance may also be improved similarly as shown in FIG. 18 through FIG. 24; it is not repeated herein.

To stably connect the dipole arm 110 to the support piece 120, the matching mounting structure and support structure may be configured in the dipole arm 110 and the support piece 120 respectively. In an exemplary embodiment of the present disclosure, the support piece 120 shown in FIG. 16 may be applicable for two types of radiating elements 100 shown in FIG. 8 and FIG. 12. Specifically, as shown in FIG. 8 through FIG. 16, every second support section 122 may comprise at least one support structure, and every second arm section 112 may comprise a mounting structure; at least a portion of the support structure of at least one support structure may be configured to match the mounting structure of the first dipole arm to support the first dipole arm, and at least a portion of the support structure of at least one support structure is configured to match the mounting structure of the second dipole arm to support the second dipole arm. In some embodiments, the support structure used to match the first dipole arm and the support structure used to match the second dipole arm may be the same support structure. In other embodiments, the support structure used to match the first dipole arm and the support structure used to match the second dipole arm may also be different support structures from a plurality of support structures.

As shown in FIG. 8 through FIG. 10, FIG. 12 through FIG. 14, and FIG. 16, the quantity of the dipole arms 110 in every radiating element 100 may be four; accordingly, the first support section 121 may comprise four first support sub-sections 1211 extending toward a first direction, a second direction, a third direction, and a fourth direction in the plane of the plate. The quantity of the second support section 122 may also be four, and each second support section 122 is provided outside of a respective one of the first support sub-sections 1211. Thus, the matching set of the first support sub-section 1211 and the second support section 122 may be used to support a dipole arm 110; the first arm section 111 and the second arm section 112 of the dipole arm 110 are supported by the first support sub-section 1121 and the second support section 122 respectively. The first direction is opposite to the second direction, and the third direction is opposite to the fourth direction; moreover, the first direction is perpendicular to the third direction, forming two polarization directions perpendicular to each other.

To reduce the weight of the support piece 120 and its material costs, as shown in FIG. 16, one or a plurality through openings 1212 may be provided in the first support sub-section 1211, and the corresponding first arm section 111 that is mounted on the first support sub-section 1211 may be set at at least a portion of the edge surrounding one or a plurality of through openings 1212. In FIG. 16, two through openings 1212 are provided in every first support sub-section 1211, and the corresponding first arm section 111 is mounted to surround the two through openings 1212.

Moreover, as shown in FIG. 16, in the support piece 120, four first support sub-sections 1211 may encircle a feeding opening 1213 located inwardly of the first support section 121. As shown in FIG. 11 and FIG. 15, the radiating element 100 may also comprise a plurality of feeding sections 130 to transmit electric signals to the corresponding dipole arms 110; wherein, the feeding sections 130 may pass through the feeding opening 1213 to connect with corresponding dipole arms 110 respectively. In some embodiments, the dipole arm 110 and the feeding section 130 connected with the dipole arm 110 may be formed as one piece; for example, it is made of metal into one piece.

As shown in FIG. 8 through FIG. 10, FIG. 12 through FIG. 14, and FIG. 16, the second support section 122 may be bent toward a first side of the first support section 121, i.e., bent forwardly, to avoid potential interference with other components that are behind the dipole arms 110 of radiating element 100. Although the second support section 122 is bent forwardly, by configuring an appropriate support structure therein and matching the mounting structure set in the second arm section of the dipole arm 110, either first dipole arms that are bent forwardly and/or second dipole arms that are bent rearwardly may be supported by such support piece 120.

Specifically, as shown in FIG. 8 through FIG. 10, FIG. 12 through FIG. 14, and FIG. 16, the support structure may comprise a first support structure 122*a* and a second support structure 122*b*. Accordingly, the mounting structure of the first dipole arm may comprise a first mounting structure 112*a* matching the first support structure 122*a*; the mounting structure of the second dipole arm may comprise a second mounting structure 112*b* matching the second support structure 122*b*. When the first mounting structure 112*a* of the first dipole arm matches the corresponding first support structure 122*a* of the second support section 122, it is supported by the support piece 120; when the second mounting structure 112*b* of the second dipole arm matches the corresponding second support structure 122*b* of the second support section 122, it is supported by the support piece 120.

Considering that the shape of the dipole arm 100 (including the widths and lengths of various arm sections or sub-arm sections as well as the angles between them) will impact the radiation performance of the radiating element 100, thus, in the first dipole arm and the second dipole arm, except for the different bending direction of the second arm section 112 relative to that of the first arm section 111, the first arm section of the first dipole arm may be made to have the same or basically the same shape as the first arm section of the second dipole arm, and the second arm section of the first dipole arm and the second arm section of the second dipole arm are of the same or basically the same shape.

As shown in FIG. 11, the first dipole arm may also comprise a second mounting structure 112*b*, and the location of the second mounting structure 112*b* of the first dipole arm on the second arm section 112 of the first dipole arm corresponds to the location of the second mounting structure 112*b* of the second dipole arm on the second arm section 112 of the second dipole arm as shown in FIG. 15. Similarly, as shown in FIG. 15, the second dipole arm may further comprise a first mounting structure 112*a*, and the location of the first mounting structure 112*a* of the second dipole arm on the second arm section 112 of the second dipole arm corresponds to the location of the first mounting structure 112*a* of the first dipole arm on the second arm section 112 of the first dipole arm as shown in FIG. 11. Thus, although the second mounting structure 112*b* of the first dipole arm and the first mounting structure 112*a* of the second dipole arm may not play a role in the actual assembly process, making the shapes of the first dipole arm and the second dipole arm similar is beneficial for maintaining the consistency of the radiation performance of different radiating elements, and may simplify the structural design of the first dipole arm and the second dipole arm.

As shown in FIG. 8 through FIG. 10, FIG. 12 through FIG. 14, and FIG. 16, a first support structure 122*a* with a first "height" (i.e., here the term "height refers to the distance that a structure extends forwardly from a reflector) relative to the first support section 121 and a second support structure 122*b* with a second height, which is different from the first height, may be configured to realize the support of the first dipole arm and the second dipole arm. As shown in FIG. 11, a first mounting structure 112*a* with a third height, which can match the first height, relative to the first arm section 111 may be configured in the first dipole arm; as shown in FIG. 15, a second mounting structure 112*b* with a fourth height, which can match the second height, relative to the first arm section 111 may be configured in the second dipole arm. Of course, as described above, as shown in FIG. 11, the first dipole arm may also comprise a second mounting structure 112*b* with a fourth height; as shown in FIG. 15, the second dipole arm may also comprise a first mounting structure 112*a* with a third height. In the support piece 120 shown in FIG. 16, the first height is greater than the second height. It can be understood that, in other embodiments, the first height may also be less than the second height.

In every second support section 122, one or more first support structure(s) 122*a* may be provided; similarly, one or more second support structure(s) 122*b* may also be provided. To ensure that the support of the first dipole arm and the second dipole arm is stable, particularly under the circumstance that there are a plurality of first support structures 122*a* or a plurality of second support structures 122*b* in the same second support section 122, the first support structures 122*a* and the second support structures 122*b* may be set in an alternating manner so that the support points of the dipole arm 110 are spread on the second support section 122 as evenly as possible. Accordingly, in the same dipole arm 110, the first mounting structure 112*a* and the second mounting structure 112*b* may also be set in an alternating manner. In the support piece 120 shown in FIG. 16, every second support section 122 comprises two first support structures 122*a* and a second support structure 122*b*, and a second support structure 122*b* is set between two first support structures 122*a*; accordingly, in the dipole arm 110 shown in FIG. 11 or FIG. 15, a second mounting structure 112*b* is set between two first mounting structures 112*a*.

There may be many different forms of the support structure and the mounting structure, which match each other. For example, the support structure may comprise at least one of the following: A support bayonet, a support screw hole set on the body of the second support section, and a support protrusion protruding relative to the body of the second support section. The mounting structure may comprise at least one of the following: A mounting bayonet formed by the bent arm section in the second arm section and a mounting screw hole set on the second arm section, and the support protrusion may be set in the mounting bayonet or the mounting screw hole to realize the connection. Furthermore, the radiating element may also comprise one or a plurality of screws; one or a plurality of screws may be configured to be fixated in at least a portion of the support structure and the mounting structure (for example, the support bayonet, the support screw hole, the mounting bayonet, and the mounting screw hole), to connect the dipole arm and the support piece.

As shown in FIG. 8 through FIG. 16, the first support structure 122*a* and the second support structure 122*b* may both be the support bayonet; the first mounting structure 112*a* may be a mounting screw hole set on the second arm section 112, and the second mounting structure 112*b* may be a mounting bayonet formed by the bent arm section in the second arm section 112. A screw 140 may pass through the matching support bayonet and mounting screw hole or pass through the matching support bayonet and mounting bayonet to fixate the second arm section 112 on the second support section 122.

As shown in FIG. 16, the second support section 122 may comprise a first rib 1221, a second rib 1222, a third rib 1223, a fourth rib 1224, a fifth rib 1225, a sixth rib 1226, and a seventh rib 1227 set in sequence and at angles with each other; every rib basically extends along a straight line. Wherein, two support bayonets as the first support structure 122*a* are formed at the connection of the second rib 1222 with the first rib 1221 and the third rib 1223 and at the connection of the sixth rib 1226 with the fifth rib 1225 and the seventh rib 1227 respectively; the support bayonet as the second support structure 122*b* is formed at the connection of the fourth rib 1224 with the third rib 1223 and the fifth rib 1225. Furthermore, the angle between adjacent ribs may be a right angle or an acute angle close to a right angle to prevent the opening of the support bayonet from being excessively large, which may result in an unstable connection.

As shown in FIG. 11 and FIG. 15, the second arm section 112 may comprise a first wide sub-arm section 1121, a second narrow sub-arm section 1122, a third narrow sub-arm section 1123, a fourth narrow sub-arm section 1124, and a fifth wide sub-arm section 1125 set in sequence and at angles with each other; every sub-arm section basically extends along a straight line. Because the width of the wide sub-arm sections is larger, it is convenient to open mounting screw holes on them. Specifically, two mounting screw holes as the first mounting structure 112*a* may be formed on the first wide sub-arm section 1121 and the fifth wide sub-arm section 1125; the mounting bayonet as the second mounting structure 112*b* may be formed at the connection of the third narrow sub-arm section 1123 with the second narrow sub-arm section 1122 and the fourth narrow sub-arm section 1124. Similarly, the angle between the adjacent narrow sub-arm sections formed as the mounting bayonet may be a right angle or an acute angle close to a right angle to prevent the opening of the mounting bayonet from being excessively large, which results in unstable connection. Furthermore, arranging the wide sub-arm sections and the narrow sub-arm sections according to a certain manner may also introduce the capacitance or inductance effect, to improve the scattering performance of the radiating element 100 on the electromagnetic waves of the high frequency radiating element below.

Similar to the connection between the second arm section 112 and the second support section 122, the connection between the first arm section 111 and the first support section 121 may also be realized. For example, the first support section 121 may comprise at least one of the following: A support screw hole 123 set on the plate of the first support section 121 and a support protrusion protruding relative to the plate of the first support section 121. The first arm section 111 may comprise at least one of the following: A mounting bayonet 113 formed by the bent arm section in the first arm section 111 and a mounting screw hole 114 set on the first arm section 111, and, the support protrusion may be set in the mounting bayonet 113 or the mounting screw hole 114 in a manner similar to a screw 140 to realize the connection. Of course, the support screw hole 123 and the mounting bayonet 113 or the support screw hole 123 and the mounting screw hole 114 may be connected in a fixed manner via a screw 140 directly.

In the exemplary embodiments of the present disclosure, as shown in FIG. 8 through FIG. 10, FIG. 12 through FIG. 14, and FIG. 16, in order to strengthen the structural stability of the radiating element 100, the support piece 120 may also comprise a plurality of support beams 124. Every support beam 124 may be connected between the first support section 121 and the corresponding support section 122 so that it, along with the first support section 121 and the second support section 122, forms a triangular support structure, to improve the structural stability. In the embodiments shown in FIG. 8 through FIG. 10, FIG. 12 through FIG. 14, and FIG. 16, the first support section 121 and every second support section 122 are connected by two support beams 124 set in parallel. It can be understood that, in other embodiments, fewer or more support beams may be configured according to the requirement for structural stability.

As shown in FIG. 16, the support piece 120 may also comprise one or a plurality of support legs 125. Each support leg 125 may be set on a second side of the first support section 121 so that the radiating element 100 is fixated at a location at a certain distance from the reflector of the antenna array.

In some embodiments, the support piece 120 may be formed as one piece, for example, it may be formed of plastic by molding. It can be understood that in the molding process, by adding or removing certain inserts in the mold, the structure of the support piece 120 may also be fine-tuned to meet the assembly requirement of the base station antenna.

The present disclosure has also proposed a base station antenna; the base station antenna may comprise the radiating element described above. Because the ends of the dipole arms of the radiating element are bent forwardly or rearwardly, the minimum distance between adjacent radiating elements in the base station antenna array may be reduced, which thus optimizes the radiation performance of the base station antenna.

Figure 26:
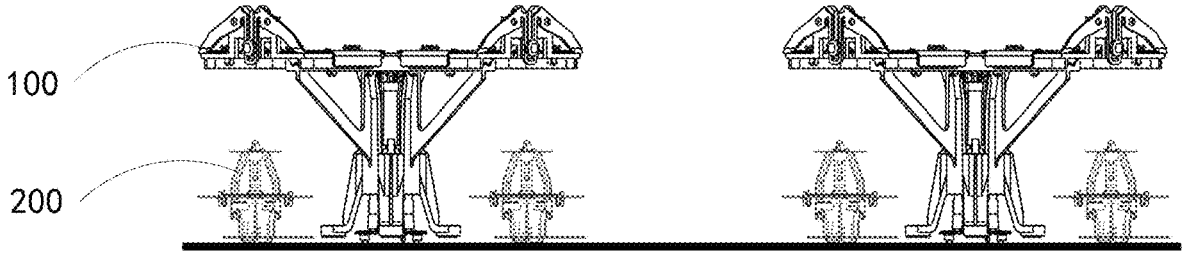
FIG. 26 is a schematic side view of a base station antenna according to the first specific embodiment of the present disclosure where the base station antenna includes two low-band antenna arrays and four high-band antenna arrays, where the two low-band arrays are formed using the radiating element of FIG. 8.
Figure 27:
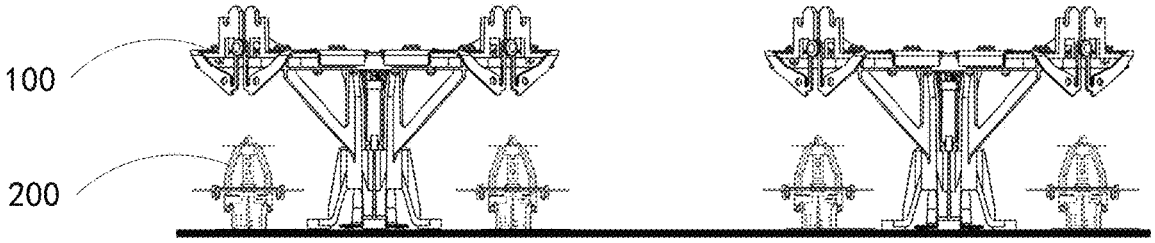
FIG. 27 is a schematic of a base station antenna according to the second specific embodiment of the present disclosure where the base station antenna includes two low-band antenna arrays and four high-band antenna arrays, where the two low-band arrays are formed using the radiating element of FIG. 12.

As shown in FIG. 26 and FIG. 27, the radiating element 100 may be used in a base station antenna that includes two low-band antenna arrays and four high-band antenna arrays, where the two low-band arrays are formed using the radiating element 100, and the high-band antenna arrays are formed using a radiating element 200.

Figure 28:
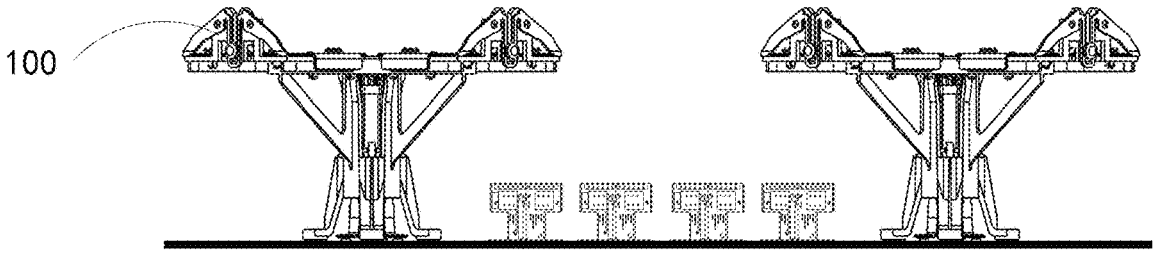
FIG. 28 is a schematic of a base station antenna according to the third specific embodiment of the present disclosure where the base station antenna includes a beamforming antenna array and two low-band arrays that are formed using the radiating element of FIG. 8.
Figure 29:
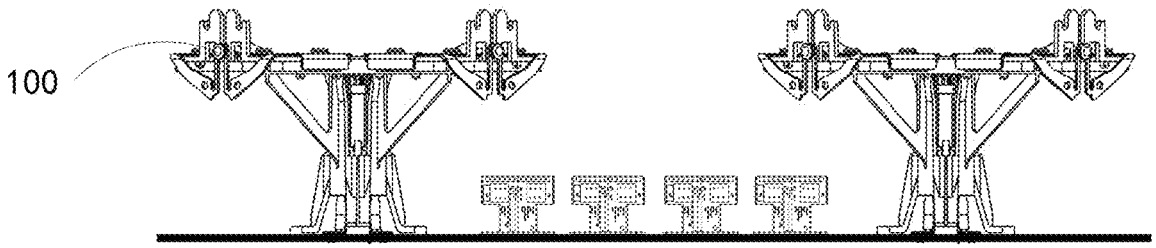
FIG. 29 is a schematic of a base station antenna according to the fourth specific embodiment of the present disclosure where the base station antenna includes a beamforming antenna array and two low-band arrays that are formed using the radiating element of FIG. 12.

As shown in FIG. 28 and FIG. 29, the radiating element 100 may also be used in a beamforming base station antenna array.

Figure 30:
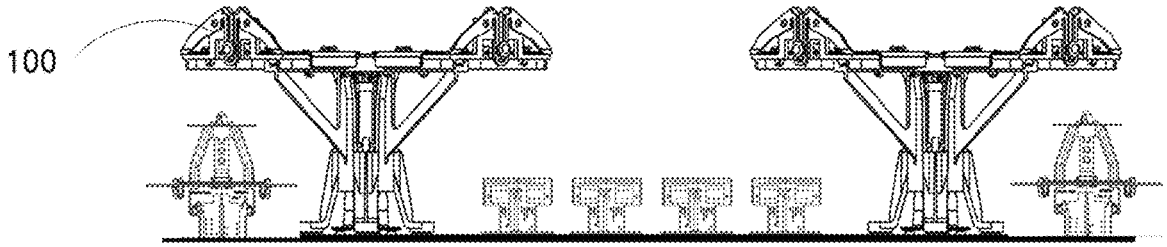
FIG. 30 is a schematic of a base station antenna according to the fifth specific embodiment of the present disclosure where the base station antenna includes a beamforming antenna array, two high-band antenna arrays and two low-band antenna arrays that are formed using the radiating element in FIG. 8.
Figure 31:
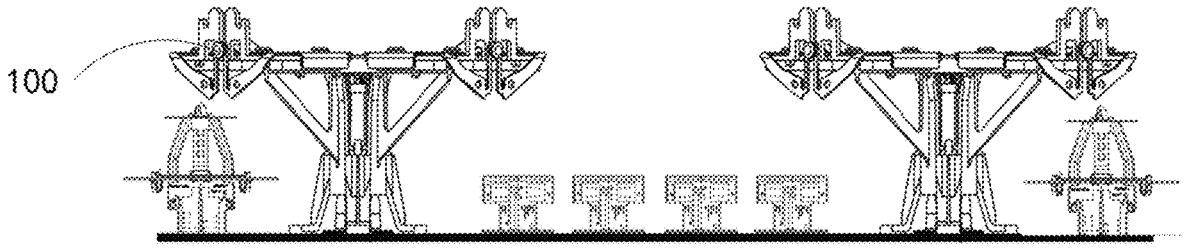
FIG. 31 is a schematic of a base station antenna according to the sixth specific embodiment of the present disclosure where the base station antenna includes a beamforming antenna array, two high-band antenna arrays and two low-band antenna arrays that are formed using the radiating element in FIG. 12.

As shown in FIG. 30 and FIG. 31, the radiating element 100 may also be used in a base station antenna that includes two low-band antenna arrays, two high-band antenna arrays and a beamforming array.

As used herein, the words "front", "rear", "top", "bottom", "above", "below", etc., if present, are used for descriptive purposes and are not necessarily used to describe constant relative positions. It should be understood that the terms used in this way are interchangeable under appropriate circumstances, so that the embodiments of the present disclosure described herein, for example, can be operated on other orientations that differ from those orientations shown herein or otherwise described.

As used herein, the word "exemplary" means "serving as an example, instance, or illustration" rather than as a "model" to be copied exactly. Any realization method described exemplarily herein is not necessarily interpreted as being preferable or advantageous over other realization methods. Furthermore, the present disclosure is not limited by any expressed or implied theory stated in the above technical field, background art, summary of the invention, or specific embodiments.

As used herein, the word "basically" means any minor changes including those caused by design or manufacturing defects, device or component tolerances, environmental influences, and/or other factors. The word "basically" also allows for the divergence from the perfect or ideal situation due to parasitic effects, noise, and other practical considerations that may be present in the actual realization.

In addition, the above description may have mentioned elements or nodes or features that are "connected" or "coupled" together. As used herein, unless explicitly stated otherwise, "connect" means that an element/node/feature is electrically, mechanically, logically, or in other manners connected (or communicated) with another element/node/feature. Similarly, unless explicitly stated otherwise, "couple" means that one element/node/feature can be mechanically, electrically, logically, or in other manners linked with another element/node/feature in a direct or indirect manner to allow for interaction, even though the two features may not be directly connected. That is, "couple" is intended to comprise direct and indirect linking of elements or other features, including connection using one or a plurality of intermediate components.

In addition, for reference purposes only, "first", "second" and similar terms may also be used herein, and thus are not intended to be limitative. For example, unless the context clearly indicates, the words "first", "second" and other such numerical words involving structures or elements do not imply a sequence or order.

It should also be noted that, as used herein, the words "include/comprise", "contain", "have", and any other variations indicate that the mentioned features, entireties, steps, operations, elements and/or components are present, but do not exclude the presence or addition of one or a plurality of other features, entireties, steps, operations, elements, components and/or combinations thereof.

In the present disclosure, the term "provide" is used in a broad sense to cover all the ways of obtaining an object, and thus "providing an object" includes but is not limited to "purchase", "preparation/manufacturing", "arrangement/setting", "mounting/assembly", and/or "order" of the object, etc.

Those of ordinary skill in the art should also realize that the boundaries between the above operations are merely illustrative. A plurality of operations can be combined into a single operation, which may be distributed in additional operations, and the operations can be executed at least partially overlapping in time. Moreover, alternative embodiments may include a plurality of instances of specific operations, and the order of operations may be changed in various other embodiments. However, other modifications, changes, and substitutions are also possible. Therefore, the Specification and attached FIG.s hereof should be regarded as illustrative rather than limitative.

Although some specific embodiments of the present disclosure have been described in detail through examples, those of ordinary skill in the art should understand that the above examples are only for illustration rather than for limiting the scope of the present disclosure. The embodiments disclosed herein can be combined arbitrarily provided that the combination does not depart from the spirit and scope of the present disclosure. Those of ordinary skill in the art should also understand that various modifications can be made to the embodiments above, provided that they do not depart from the scope and spirit of the present disclosure. The scope of the present disclosure is defined by the attached claims.

That which is claimed is:

1. A radiating element, comprising:

a support piece comprising a first support section and first through fourth second support sections that are each positioned outwardly of the first support section and bent relative to the first support section, each of the first through fourth second support sections comprising at least one support structure;

first through fourth dipole arms that each comprise a first arm section and a second arm section positioned outwardly of the first arm section, where every second arm section comprises a mounting structure, wherein the second arm section of the first dipole arm is bent relative to the first arm section toward a first side of the first support section such that the first and second arm sections of the first dipole arm lie in different planes, wherein the second arm section of the second dipole arm is bent relative to the first arm section thereof toward a second side of the first support section that is opposite the first side such that the first and second arm sections of the second dipole arm lie in different planes, wherein a first portion of the at least one support structure of each of the first through fourth second support sections is configured to match the mounting structure of the first dipole arm, and a second portion of the at least one support structure of each of the first through fourth second support sections is configured to match the mounting structure of the second dipole arm.

2. The radiating element of claim 1, wherein the first support section has a plate-like shape.

3. The radiating element of claim 1, wherein each second support section is bent toward the first side of the first support section.

4. The radiating element of claim 1, wherein the at least one support structure of each of the first through fourth second support sections comprises a support bayonet, a support screw hole, or a support protrusion.

5. The radiating element of claim 1, wherein the at least one support structure of each of the first through fourth second support sections comprises a first support and a second support structure, where the first support structure is positioned forwardly of the second support structure.

6. The radiating element of claim 5, wherein the first second support section comprises a first rib, a second rib, a third rib, a fourth rib, a fifth rib, a sixth rib, and a seventh rib set in sequence and at angles with each other, wherein the first support structure comprises two support bayonets formed at the connection of the second rib with the first rib and the third rib and at the connection of the sixth rib with the fifth rib and the seventh rib respectively, and wherein the second support structure comprises a support bayonet formed at the connection of the fourth rib with the third rib and the fifth rib.

7. The radiating element of claim 1, wherein the first support section comprises four first support sub-sections that extend in respective first through fourth directions, wherein each of the first through fourth second support section is set on the outside of a respective one of the first support sub-sections, and wherein the first direction is opposite the second direction, the third direction is opposite to the fourth direction; moreover, and the first direction is perpendicular to the third direction.

8. The radiating element of claim 7, wherein each first support sub-section includes at least one through opening.

9. The radiating element of claim 7, wherein the four first support sub-sections encircle a feed opening.

10. The radiating element of claim 1, wherein the support piece further comprises a plurality of support beams that extend between the first support section and the corresponding second support sections.

11. The radiating element of claim 10, wherein the support piece further comprises a plurality of support legs that are positioned on the second side of the first support section.

12. The radiating element of claim 11, wherein the support piece is a monolithic structure.

13. A radiating element that is configured to be mounted on a reflector, the radiating element comprising:

a first dipole that includes a first dipole arm and a second dipole arm;

a second dipole that includes a third dipole arm and a fourth dipole arm, the second dipole extending perpendicularly to the first dipole, wherein each of the first through fourth dipole arms comprises a plurality of widened conductive segments that are connected by a plurality of narrowed conductive segments, and each of the first through fourth dipole arms has a base that is proximate a center of the radiating element and a distal end that is opposite the base, and wherein the distal end of each of the first through fourth dipole arms is bent either rearwardly or forwardly with respect to a plane that is parallel to the reflector such that the distal end and a proximal end of each of the first through fourth dipole arms lie in different planes with respect to each other.

14. The radiating element of claim 13, wherein the distal end of each of the first through fourth dipole arms comprises a narrowed conductive segment.

15. The radiating element of claim 13, wherein the distal end of each of the first through fourth dipole arms is bent at least 30 degrees with respect to the plane that is parallel to the reflector.

16. The radiating element of claim 13, wherein the distal end of each of the first through fourth dipole arms is bent about 90 degrees with respect to the plane that is parallel to the reflector.

17. The radiating element of claim 13, wherein the distal ends of at least some of the first through fourth dipole arms are bent rearwardly and the distal ends of at least some of the first through fourth dipole arms are bent forwardly.

18. The radiating element of claim 13, wherein one of the narrowed conductive segments of each of the first through fourth dipole arms is bent with respect to the plane that is parallel to the reflector.

19. The radiating element of claim 13, further comprising a support piece that includes a first support section and first through fourth second support sections that are each positioned outwardly of the first support section and bent relative to the first support section, each of the first through fourth second support sections comprising at least one support structure.

* * * * *